US006276397B1

(12) United States Patent
Weber et al.

(10) Patent No.: US 6,276,397 B1
(45) Date of Patent: Aug. 21, 2001

(54) APPARATUS AND METHOD FOR SHAPING FLUID FLOW

(75) Inventors: Robert T. Weber; George T. Watson, III, both of Dallas; John M. Trantham, Hurst, all of TX (US)

(73) Assignee: Flow Design, Inc., Dallas, TX (US)

( * ) Notice: Subject to any disclaimer, the term of this patent is extended or adjusted under 35 U.S.C. 154(b) by 0 days.

(21) Appl. No.: 09/611,359

(22) Filed: Jul. 6, 2000

Related U.S. Application Data

(60) Provisional application No. 60/210,921, filed on Jun. 12, 2000.

(51) Int. Cl.[7] ..... F15D 1/02
(52) U.S. Cl. ..... 138/37; 138/44
(58) Field of Search ..... 138/37, 40, 44

(56) References Cited

U.S. PATENT DOCUMENTS

| | | | | |
|---|---|---|---|---|
| 2,005,385 | * | 6/1935 | O'Hara | 138/40 |
| 2,397,655 | * | 4/1946 | Francis | 138/25 |
| 5,085,058 | * | 2/1992 | Aaron et al. | 138/44 X |
| 5,174,113 | * | 12/1992 | Deville | 138/44 X |
| 5,433,243 | | 7/1995 | Griswold et al. | 137/498 |
| 5,592,974 | * | 1/1997 | Grohs et al. | 138/44 |
| 5,632,242 | * | 5/1997 | Harde | 138/44 X |
| 5,647,201 | * | 7/1997 | Hook et al. | 138/44 X |
| 5,937,890 | | 8/1999 | Marandi | 137/271 |
| 5,992,466 | * | 11/1999 | Weise | 138/44 |
| 6,024,129 | * | 2/2000 | Schima | 138/44 |
| 6,119,728 | * | 9/2000 | Seidel-Peschmann et al. | 138/44 X |

* cited by examiner

*Primary Examiner*—Patrick Brinson
(74) *Attorney, Agent, or Firm*—Baker Botts L.L.P.

(57) ABSTRACT

An apparatus for shaping fluid flow comprises a body having upstream and downstream ends and formed with a characterizing channel. The characterizing channel has a first cross-section adjacent the upstream end that gradually changes to a second cross-section adjacent the downstream end that is different in configuration from the first cross-section.

21 Claims, 3 Drawing Sheets

APPARATUS AND METHOD FOR SHAPING FLUID FLOW

RELATED APPLICATIONS

This application claims the benefit under 35 U.S.C., §119(e), of U.S. provisional patent application Ser. No. 60/210,921 filed Jun. 12, 2000.

TECHNICAL FIELD OF THE INVENTION

This invention relates generally to the field of fluid flow and, more specifically, to an apparatus and method for shaping fluid flow.

BACKGROUND OF THE INVENTION

Fluid piping systems often include junctions between devices where the cross-sectional flow area changes abruptly. A ball valve, which provides volumetric control of fluid flow in a piping system, adjoining a circular pipe is an example of this. Often, immediately preceding a ball valve is a venturi meter, which measures flow rate by measuring a pressure drop across the venturi meter.

The abrupt changes in cross-sectional flow area at these junctions create turbulence in the piping system. Generally, turbulence is undesirable in most piping systems because it results in greater pressure drops, noise, and erosion in the piping system. Furthermore, turbulence makes volumetric control of fluid flow in a piping system difficult.

Some prior systems have recognized the desirability of providing particular cross-sectional flow areas immediately preceding certain devices. For example, controlling volumetric flow rate through a ball valve is difficult because of the nature of the ball valve when the ball valve is being closed. The shape of the bore in the ball valve, and the corresponding shape of the fluid entering the ball valve, combine to produce difficult conditions for providing the desired throttling of fluid flow. Therefore, prior systems have utilized washers having particular shapes immediately preceding the ball valve. However, the shape of these washers do not address turbulence that is created due to abrupt changes in cross-sectional flow areas, and in fact, create additional turbulence, noise, and erosion. Another method for aiding volumetric flow control is to either machine the bore of a ball valve into a predetermined shape, or to provide an insert having a predetermined shape in a ball valve, such as that described in U.S. Pat. No. 5,937,890. However, these methods result in the same problems as the washers discussed above. Additionally, these bores and/or inserts may be expensive to manufacture and may result in extra assembly costs.

SUMMARY OF THE INVENTION

Therefore, a need has arisen for a new apparatus and method for shaping fluid flow. In accordance with the present invention, an apparatus and method for shaping fluid flow is provided that addresses disadvantages and problems associated with previously developed apparatuses and methods.

An apparatus for shaping fluid flow comprises a body having upstream and downstream ends and formed with a characterizing channel. The characterizing channel has a first cross-section adjacent the upstream end that gradually changes to a second cross-section adjacent the downstream end that is different in configuration from the first cross-section.

A method for shaping fluid flow includes allowing fluid to flow through a characterizing channel formed within a body having upstream and downstream ends, and shaping the fluid by gradually changing the cross-section of the characterizing channel from a first cross-section adjacent the upstream end to a second cross-section adjacent the downstream end that is different in configuration from the first cross-section.

Embodiments of the invention provide numerous technical advantages. For example, a technical advantage of one embodiment of the present invention is that it provides better constant flow control through a ball valve as the ball valve is being turned from open to closed. Another technical advantage of one embodiment of the present invention is that less pressure drop occurs over the length of the apparatus because there are less frictional losses as a result of the characterizing section of the apparatus. An additional technical advantage of one embodiment of the present invention is the characterizing section of the apparatus reduces turbulence, noise, and erosion in the piping system. A still further technical advantage of one embodiment of the present invention is that the performance of a flow measurement device is improved as a result of a higher signal produced by the flow shaping apparatus.

Other technical advantages arc readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF THE INVENTION

Embodiments of the present invention and its advantages are best understood by referring now to FIGURES 1A through 3D of the drawings, in which like numerals refer to like parts.

Figure 1A:
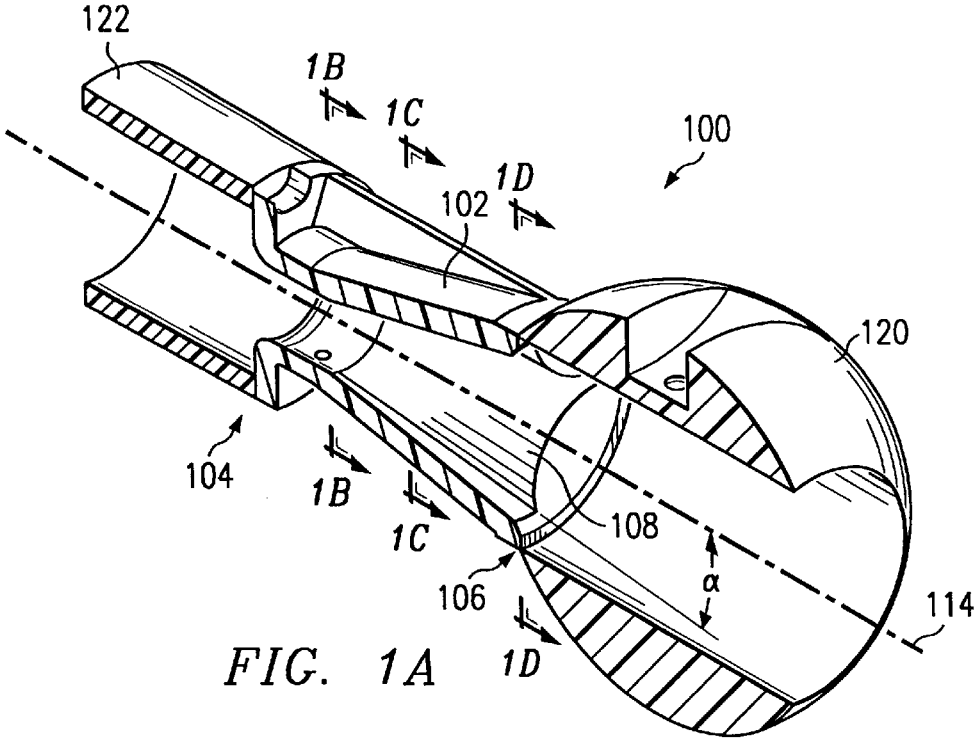
FIG. 1A is a sectional perspective view illustrating a piping system utilizing one embodiment of a flow shaping apparatus in accordance with the present invention, showing the flow shaping apparatus as a portion of a venturi meter coupled to a pipe at an upstream end and a ball valve at a downstream end.

FIG. 1A is a perspective sectional view illustrating a piping system 90 utilizing one embodiment of a flow shaping apparatus 100 in accordance with the present invention. FIG. 1A shows apparatus 100 coupled to a pipe 122 at an upstream end 104 and coupled to a ball valve 120 at a downstream end 106 (the housing of the ball valve is not shown for clarity). Piping system 90 may be any conventional piping system, such as that used an HVAC system, and apparatus 100 may be coupled to pipe 122 in any conventional manner, such as welding, bolting, or through a screwed connection. Apparatus 100 shapes fluid flowing through apparatus 100 before entering ball valve 120 to reduce turbulence and noise before the fluid enters ball valve 120. This is particularly advantageous when, for example, an abrupt change in cross-sectional flow area is encountered. Apparatus 100, in addition to shaping fluid flow, may also act as a flow measurement device. For example, apparatus 100 may be a venturi meter, as shown in FIG. 1A, to measure flow before the fluid enters a ball valve. In that case, apparatus 100 would, in addition to reducing turbulence and noise, reduce the pressure drop through the venturi meter thus improving the efficiency of apparatus 100.

Apparatus 100 comprises a body 102, a characterizing channel 108, upstream end 104, and downstream end 106. Body 102 is the solid portion of apparatus 100 and in one embodiment is made of a polymer; however, body 102 may be made of other materials, such as metal or other suitable materials that may be used in piping systems. Body 102 is formed with a characterizing channel 108, which shapes fluid flowing through piping system 90 as the fluid enters upstream end 104 and exits downstream end 106 of apparatus 100.

Figure 1B:
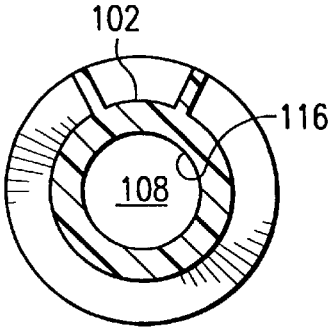
FIG. 1B is a cross-sectional view of the upstream end of the flow shaping apparatus shown in FIG. 1A.
Figure 1C:
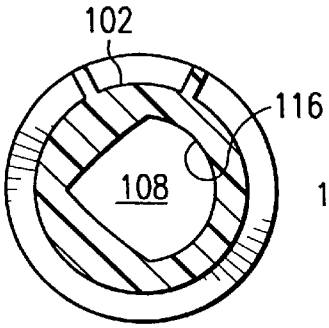
FIG. 1C is a cross-sectional view of an intermediate portion of the flow shaping apparatus shown in FIG. 1A.
Figure 1D:
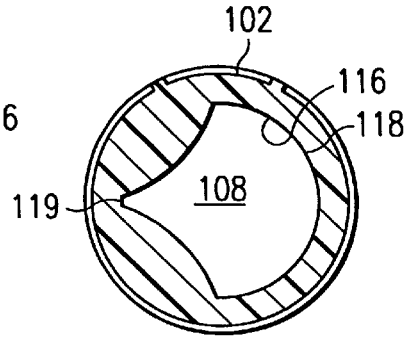
FIG. 1D is a cross-sectional view of the downstream end of the flow shaping apparatus shown in FIG. 1A.

FIGS. 1B, 1C, and 1D show the progression of the cross-section of characterizing channel 108 moving from upstream end 104 to downstream end 106. At upstream end 104, characterizing channel 108 has a first cross-section 110 that can be any desired shape; however, in one embodiment, first cross-section 110 is substantially circular as shown in FIG. 1B to match the cross-sectional shape of pipe 122. The cross-sectional shape of characterizing channel 108 gradually changes from first cross-section 110 to a second cross-section 112 while moving from upstream end 104 to downstream end 106 as shown best in FIGS. 1C and 1D. The cross-sectional shapes shown in FIGURES 1B, 1C, and 1D are only one of many examples of how the cross-section of characterizing channel 108 may change. Other particular cross-sectional shapes for characterizing channel 108 are described in greater detail below.

Characterizing channel 108 has an inner wall 116 that defines a flow passage for fluid in piping system 90. Inner wall 116 may be a myriad of shapes; however, the more linear the change is from first cross-section 110 to second cross-section 112, the better the reduction in turbulence and noise. In one embodiment, inner wall 116 is defined by a plurality of substantially straight lines that connect first cross-section 110 at upstream end 104 to second cross-section 112 at downstream end 106. In other words, if a radial point at zero degrees on first cross-section 110 is connected by a substantially straight line to approximately the same radial point on second cross-section 112 at downstream end 106, then this line would be a substantially straight line. In this embodiment, the angle $\alpha$ shown in FIG. 1A is the maximum angle of any one substantially straight line on inner wall 116 with respect to the longitudinal axis 114 of apparatus 100. If the cross-section of characterizing channel 108 diverges as shown in FIG. 1A, then the angle $\alpha$ is between approximately five and ten degrees; however, the angle $\alpha$ may also be outside this range. In one embodiment, angle $\alpha$ is approximately 7.5 degrees, meaning the maximum angle of divergence would be approximately 7.5 degrees.

FIG. 1D shows second cross-section 112 of characterizing channel 108 along the line 1D—1D near downstream end 106. Characterizing channel 108 gradually shapes fluid flowing in apparatus 100 into the shape of second cross-section 112 of downstream end 106 before the fluid enters ball valve 120. Second cross-section 112 may be a myriad of shapes. Generally, however, the shape is as shown in FIG. 1D where the cross-section decreases from a leading edge 118 to a trailing edge 119. In one embodiment, second cross-section 112 at downstream end 106 of characterizing channel 108 is determined by the equal percentage volumetric flow control method. The equal percentage volumetric flow control method is a method in which the flow is changed a certain percentage for every specific degree of turn of ball valve 120. For example, for every ten degrees turn of ball valve 120, the flow is changed by ten percent. The general equation expressing the equal percentage volumetric flow control method is as follows:

$$\frac{dAe}{d\theta} = \lambda \cdot Ae(\theta)$$

where $\lambda$=constant; $A_e$=total open flow area at downstream end 106 of apparatus 100; $\theta$=angular position of ball valve. As one example, the shape of second cross-section 112 is determined by the following equations:

$$[\text{x-coord.}]: x(y,r,R,\Theta) = \sqrt{(r^2-y^2)}\cdot\cos\Theta - \sqrt{(R^2-r^2)}\cdot\sin\Theta$$

$$[y-coord.]: \lambda \cdot A_0 \cdot e^{\left(\lambda \cdot \frac{\Theta}{\Theta_{max}}\right)} = -1\cdot\left(y\cdot\sqrt{(r^2-y^2)} + r^2\cdot\arcsin\left(\frac{y}{r}\right)\right)\cdot\sin\Theta - 2\cdot[((R^2-r^2))]\left(\frac{1}{2}\right)\cdot\cos\Theta\cdot y$$

where $\lambda$=constant; $A_0$=initial flow area at downstream end 106 of apparatus 100 when ball valve 120 is fully open; $\theta$=angular position of ball valve; $\Theta_{max}$=angular position of ball valve when closed; y=vertical position of a point on inner wall 116 at $\Theta$; r=radius of bore in ball valve; R=radius of ball valve; and the bore in ball valve 120 refers to the open channel contained in ball valve 120.

Referring to FIGS. 1A through 1D, in one cycle of operation a fluid flows through pipe 122 and enters apparatus 100 (which acts as a venturi meter in this embodiment) via characterizing channel 108. The fluid is shaped by inner wall 116 of characterizing channel 108 from first cross-section 110 at upstream end 104 into second cross-section 112 at downstream end 106 before entering ball valve 120. Characterizing channel 108 smoothly shapes the fluid before entering ball valve 120 so as to reduce turbulence, noise, and pressure drop through apparatus 100.

Figure 2A:
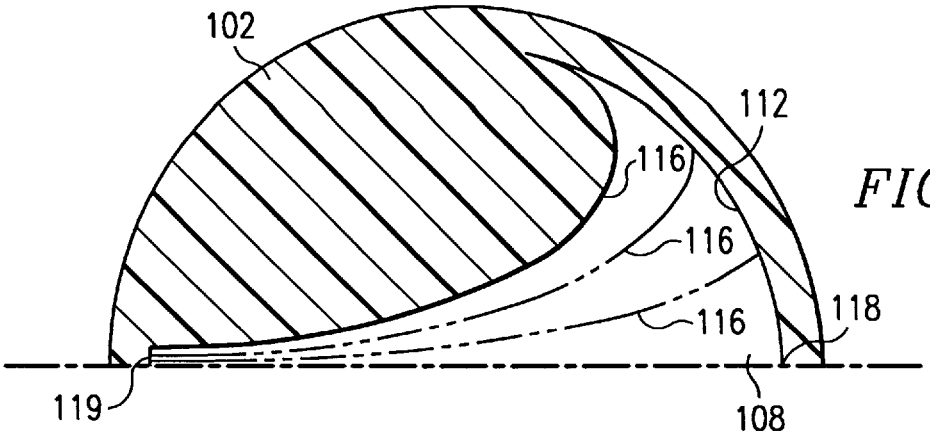
FIG. 2A is a cross-sectional view of one-half of the downstream end of a flow shaping apparatus illustrating various possible non-circular cross-sections.

FIG. 2A is a cross-sectional view of one-half of characterizing channel 108 at downstream end 106 showing a plurality of different second cross-sections 112 for varying maximum cross-sectional flow areas. These shapes are derived using the equal percentage volumetric flow control method, using a value of $\lambda$ equal to approximately three.

Figure 2B:
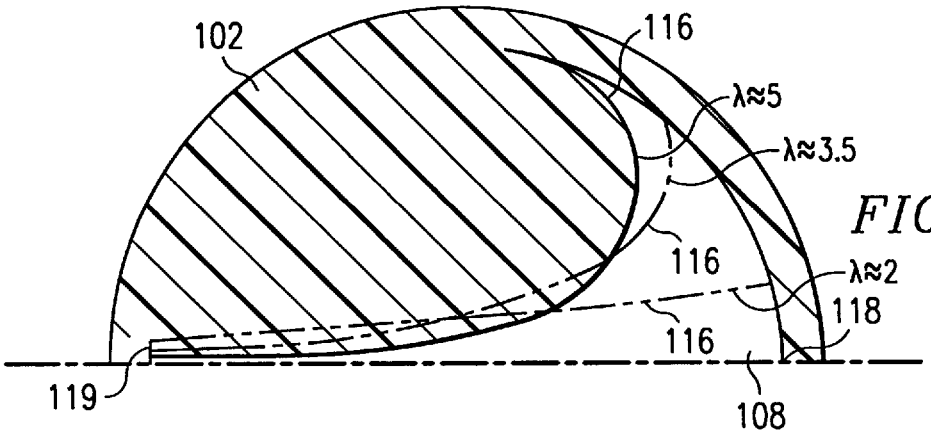
FIG. 2B is a cross-sectional view of one-half of the downstream end of a flow shaping apparatus illustrating additional various possible non-circular cross-sections.

FIG. 2B is a cross-sectional view of one-half of characterizing channel 108 at downstream end 106 showing additional second cross-sections 112 for varying λ's. A higher value of λ means that a higher percentage of fluid flow is reduced for the same degree turn of ball valve 120. These profiles were also derived using the equal percentage volumetric flow control method. With the equal percentage volumetric flow control method, there is some point at which second cross-section 112 deviates from the equation so ball valve 120 can shut-off fluid flow completely. The location where second cross-section 112 starts to deviate is when the valve is approximately 85–95% closed. As described below, second cross-section 112 of downstream end 106 provides for uniform variation in fluid flow while ball valve 120 is being closed.

Figure 2C:
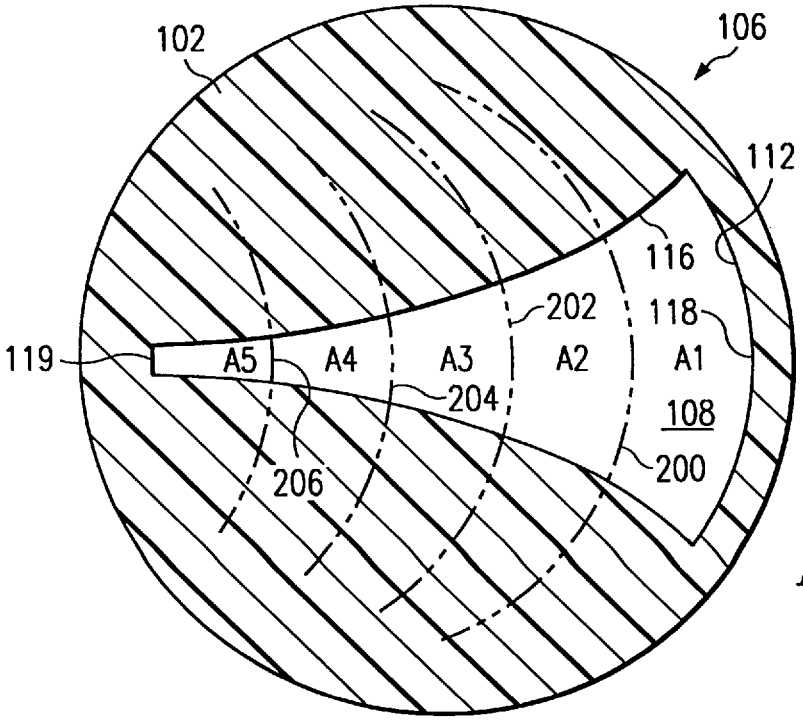
FIG. 2C is a cross-sectional view of the downstream end of a flow shaping apparatus illustrating different stages of a ball valve closing.

FIG. 2C is a cross-sectional view of characterizing channel 108 at downstream end 106 with the outline of the bore in ball valve 120 superimposed on characterizing channel 108, illustrating the overlap of flow area between second cross-section 112 and the open flow area of ball valve 120 for various angular positions. Only one example of second cross-section 112 of downstream end 106 is shown. As can be seen in FIG. 2C, second cross-section 112 of downstream end 106, in conjunction with the shape of the bore of ball valve 120, provides for uniform variation in fluid flow while ball valve 120 is being closed from the open position. This is because second cross-section 112 was generated using the equal percentage volumetric flow control method as described above. This means the total fluid flow area is reduced a certain percentage for every certain degree turn of ball valve 120. As an example, when the edge of the bore in ball valve 120 is in profile position 300, then approximately 60% (40%×100%) of the total fluid flow area remains. This means that area A1 is 40% of the total available area (i.e., A1+A2+A3+A4+A5). Further demonstrating the example, at profile position 302, 36% (40%×60%) of the total fluid flow area remains. This means that area A2 is 24% of the total available area. This continues until the flow is completely shut-off at trailing edge 119. Thus, uniform variation in fluid flow can be obtained utilizing the equal percentage volumetric flow control method when generating second cross-section 112 at downstream end 106 of characterizing channel 108.

Figure 3A:
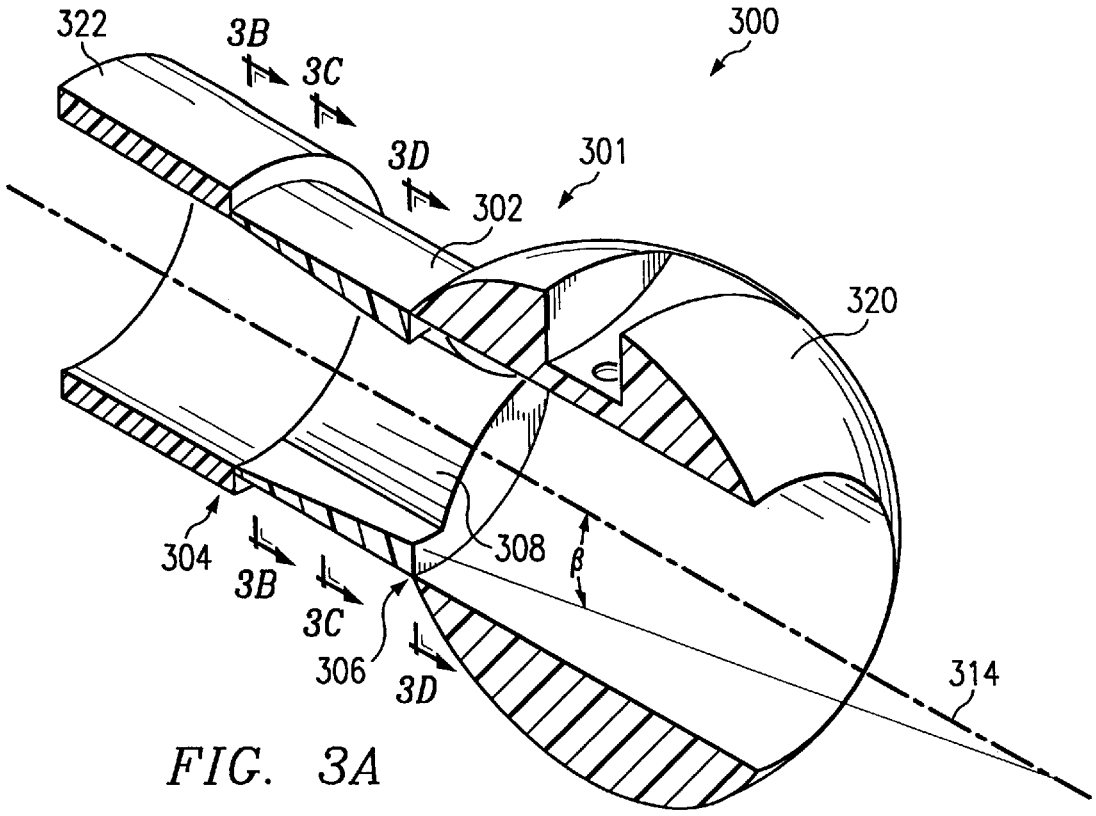
FIG. 3A is a sectional perspective view illustrating another embodiment of a flow shaping apparatus in accordance with the present invention.
Figure 3B:
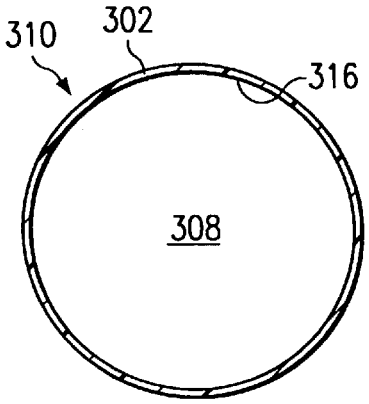
FIG. 3B is a cross-sectional view of the upstream end of the apparatus showing a first cross-section of a characterizing channel formed within the apparatus.
Figure 3C:
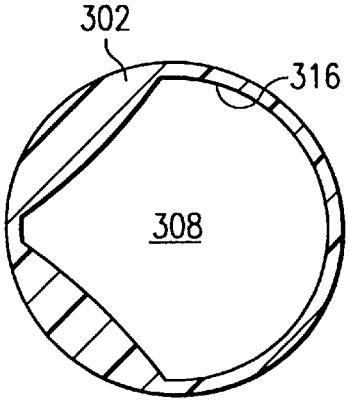
FIG. 3C is a cross-sectional view of an intermediate portion of the apparatus showing a cross-section of the characterizing channel formed within the apparatus.
Figure 3D:
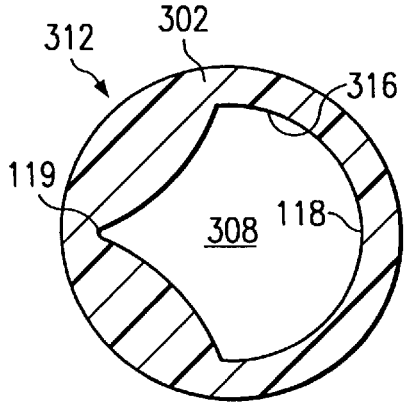
FIG. 3D is a cross-sectional view of the downstream end of the apparatus showing a second cross-section of a characterizing channel formed within the apparatus.

FIG. 3A is a perspective sectional view illustrating a piping system 300 utilizing one embodiment of a flow shaping apparatus 301 in accordance with the present invention. FIG. 3A shows apparatus 301 coupled to a pipe 322 at an upstream end 304 and a ball valve 320 at a downstream end 306. In this embodiment, apparatus 301 is a flow shaping device in which fluid flows in a characterizing channel 308 that is formed within a body 302. As opposed to the flow shaping apparatus 100 shown in FIGS. 1A–1D, in this embodiment, the fluid converges from a first cross-section 310 at upstream end 304 as shown in FIG. 3B to a second cross-section 312 at downstream end 306 as shown in FIG. 3D. As described below, second cross-section 312 at downstream end 306 allows for a more uniform flow control when ball valve 320 is closed. Second cross-section 312 of characterizing channel 308 at downstream end 306 may be a myriad of shapes. Typically, second cross-section 312 has a shape that decreases from a leading edge 318 to a trailing edge 319 as shown in FIG. 3D. In one embodiment, second cross-section 312 is determined by the equal percentage volumetric flow control method as discussed above.

As with the embodiment shown in FIGS. 1A–1D, characterizing channel 308 has an inner wall 316 that defines a flow passage for fluid in piping system 300. Inner wall 316 may be a myriad of shapes; however, the more linear the interpretation is from first cross-section 310 to second cross-section 312, the better the reduction in turbulence and noise. In one embodiment, inner wall 316 is defined by a plurality of substantially straight lines that connect first cross-section 310 to second cross-section 312 at corresponding radial points. FIGS. 3B–3D show the progression of the cross-section of characterizing channel 308 moving from upstream end 304 to downstream end 306. Angle β as shown in FIG. 3A is the maximum angle, in this embodiment, of any one straight line on inner wall 316 with respect to a longitudinal axis 314 of apparatus 301. If the cross-section of characterizing channel 308 converges as shown in FIGS. 3A through 3D, then in this embodiment the angle β is between approximately fifteen and twenty-five degrees; however, angles of convergence may exceed this range in other embodiments. In one embodiment, the angle β is approximately twenty-one degrees.

Although embodiments of the invention and its advantages are described in detail, a person skilled in the art could make various alternations, additions, and omissions without departing from the spirit and scope of the present invention as defined by the appended claims.

What is claimed is:

1. An apparatus for shaping fluid flow, comprising:

a body having upstream and downstream ends and formed with a characterizing channel, the characterizing channel having a first cross-section adjacent the upstream end that gradually changes to a second cross-section adjacent the downstream end, the second cross-section being different in configuration from the first cross-section, wherein the body couples to a portion of a venturi meter adjacent the upstream end.

2. An apparatus for shaping fluid flow, comprising:

a body having upstream and downstream ends and formed with a characterizing channel, the characterizing channel having a first cross-section adjacent the upstream end that gradually changes to a second cross-section adjacent the downstream end, the second cross-section being different in configuration from the first cross-section, wherein the characterizing channel has an inner wall defined by a plurality of substantially straight lines connecting the first cross-section to the second cross-section at approximate corresponding radial points.

3. An apparatus for shaping fluid flow, comprising:

a body having upstream and downstream ends and formed with a characterizing channel, the characterizing channel having a first cross-section adjacent the upstream end that gradually diverges to a second cross-section adjacent the downstream end, the second cross-section being different in configuration from the first cross-section, wherein the characterizing channel has an inner wall and the maximum angle of divergence of the characterizing channel inner wall is between approximately five and ten degrees.

4. An apparatus for shaping fluid flow, comprising:

a body having upstream and downstream ends and formed with a characterizing channel, the characterizing channel having a first cross-section adjacent the upstream end that radially diverges to a second cross-section adjacent the downstream end, the second cross-section being different in configuration from the first cross-section, wherein the characterizing channel has an inner wall and the maximum angle of divergence of the characterizing channel inner wall is approximately 7.5 degrees.

5. An apparatus for shaping fluid flow, comprising:

a body having upstream and downstream ends and formed with a characterizing channel, the characterizing channel having a first cross-section adjacent the upstream end that gradually converges to a second cross-section adjacent the downstream end, the second cross-section being different in configuration from the first cross-section, wherein the characterizing channel has an inner wall and the maximum angle of convergence of the characterizing channel inner wall is between approximately fifteen and twenty-five degrees.

6. An apparatus for shaping fluid flow, comprising:

a body having upstream and downstream ends and formed with a characterizing channel, the characterizing channel having a first cross-section adjacent the upstream end that gradually converges to a second cross-section adjacent the downstream end, the second cross-section being different in configuration from the first cross-section, wherein the characterizing channel has an inner wall and the maximum angle of convergence of the characterizing channel inner wall is approximately twenty-one degrees.

7. An apparatus for shaping fluid flow, comprising:

a body having upstream and downstream ends and formed with a characterizing channel, the characterizing channel having a first cross-section adjacent the upstream end that gradually changes to a second cross-section adjacent the downstream end, the second cross-section being different in configuration from the first cross-section, and wherein approximately eighty-five to ninety-five percent of the second cross-section is defined using an equal percentage volumetric flow control method.

8. An apparatus for shaping fluid flow, comprising:

a body having upstream and downstream ends and formed with a characterizing channel having an inner wall, the characterizing channel defined by a first cross-section adjacent the upstream end that gradually diverges to a second cross-section adjacent the downstream end that is different in configuration from the first cross-section, the maximum angle of divergence of the characterizing channel inner wall being approximately 7.5 degrees.

9. The apparatus of claim 8 wherein the body is a portion of a venturi meter.

10. The apparatus of claim 8 wherein approximately 85 to 95 percent of the second cross-section is defined using an equal percentage volumetric flow control method.

11. The apparatus of claim 8 wherein the characterizing channel inner wall is defined by a plurality of substantially straight lines connecting the first cross-section to the second cross-section at corresponding radial points.

12. An apparatus for shaping fluid flow, comprising:

a body having upstream and downstream ends and formed with a characterizing channel having an inner wall, the characterizing channel defined by a first cross-section adjacent the upstream end that gradually converges to a second cross-section adjacent the downstream end that is different in configuration from the first cross-section; and wherein the maximum angle of convergence of the characterizing channel inner wall being approximately twenty-one degrees.

13. The apparatus of claim 12 wherein approximately 85 to 95 percent of the second cross-section is defined using an equal percentage volumetric flow control method.

14. The apparatus of claim 12 wherein the characterizing channel inner wall is defined by a plurality of substantially straight lines connecting the first cross-section to the second cross-section at corresponding radial points.

15. A method for addressing turbulence in fluid flow, comprising:

allowing fluid to flow through a characterizing channel formed within a body having upstream and downstream ends, wherein the body couples to a portion of a venturi meter adjacent the upstream end; and shaping the fluid by gradually changing the cross-section of the characterizing channel from a first cross-section adjacent the upstream end to a second cross-section adjacent the downstream end that is different in configuration from the first cross-section.

16. A method for addressing turbulence in fluid flow, comprising:

allowing fluid to flow through a characterizing channel formed within a body having upstream and downstream ends;

shaping the fluid by gradually changing the cross-section of the characterizing channel from a first cross-section adjacent the upstream end to a second cross-section adjacent the downstream end that is different in configuration from the first cross-section; and defining the characterizing channel inner wall by a plurality of straight lines that connect the first cross-section to the second cross-section at approximate corresponding radial points.

17. A method for addressing turbulence in fluid flow, comprising:

allowing fluid to flow through a characterizing channel formed within a body having upstream and downstream ends;

shaping the fluid by gradually diverging the cross-section of the characterizing channel from a first cross-section adjacent the upstream end to a second cross-section adjacent the downstream end that is different in configuration from the first cross-section, wherein the characterizing channel has an inner wall and the maximum angle of divergence of the characterizing channel inner wall is approximately 7.5 degrees.

18. A method for addressing turbulence in fluid flow, comprising:

allowing fluid to flow through a characterizing channel formed within a body having upstream and downstream ends;

shaping the fluid by gradually converging the cross-section of the characterizing channel from a first cross-section adjacent the upstream end to a second cross-section adjacent the downstream end that is different in configuration from the first cross-section, wherein the characterizing channel has an inner wall and the maximum angle of convergence of the characterizing channel inner wall is approximately twenty-one degrees.

19. A method for addressing turbulence in fluid flow, comprising:

allowing fluid to flow through a characterizing channel formed within a body having upstream and downstream ends;

shaping the fluid by gradually changing the cross-section of the characterizing channel from a first cross-section adjacent the upstream end to a second cross-section adjacent the downstream end that is different in configuration from the first cross-section, wherein approximately 85 to 95 percent of the second cross-section is defined using an equal percentage volumetric flow control method.

20. An apparatus for shaping fluid flow, comprising:

a body having upstream and downstream ends and formed with a characterizing channel having a longitudinal axis, the characterizing channel having a first cross-section adjacent the upstream end that gradually diverges to a second cross-section adjacent the downstream end, the second cross-section being different in configuration from the first cross-section, and wherein the cross-sectional area of the characterizing channel increases while moving from the upstream end to the downstream end.

21. An apparatus for shaping fluid flow, comprising:

a body having upstream and downstream ends and formed with a characterizing channel having a longitudinal axis, the characterizing channel having a first cross-section adjacent the upstream end that gradually converges to a second cross-section adjacent the downstream end, the second cross-section being different in configuration from the first cross-section, and wherein the cross-sectional area of the characterizing channel decreases while moving from the upstream end to the downstream end.

* * * * *